United States Patent [19]

Brimo et al.

[11] Patent Number: 4,612,102

[45] Date of Patent: Sep. 16, 1986

[54] SILVER RECOVERY SYSTEM

[75] Inventors: René J. Brimo, Kirkland; John Larivière, Laval; James Riedl, Pierrefonds, all of Canada

[73] Assignee: Siltec Marketing International Ltd., Dorval, Canada

[21] Appl. No.: 758,504

[22] Filed: Jul. 24, 1985

[51] Int. Cl.[4] ..... C25C 7/06; C25D 21/18

[52] U.S. Cl. ..... 204/228; 204/237; 204/269; 204/272; 204/109

[58] Field of Search ..... 204/109, 228, 237, 272, 204/273, 269

[56] References Cited

U.S. PATENT DOCUMENTS

| | | | |
|---|---|---|---|
| 3,418,225 | 12/1968 | Wick et al. | 204/109 |
| 3,551,318 | 12/1970 | Snook et al. | 204/228 |
| 3,616,412 | 10/1971 | Gnage | 204/195 |
| 3,616,435 | 10/1971 | Favell et al. | 204/228 |
| 3,705,716 | 12/1972 | Hendrickson | 204/109 X |
| 3,751,355 | 8/1973 | Mandroian | 204/228 |
| 3,925,184 | 12/1975 | Cave | 204/228 X |
| 3,980,538 | 9/1976 | Higgins | 204/109 |
| 4,018,658 | 4/1977 | Alfin et al. | 204/272 X |
| 4,026,784 | 5/1977 | Rivers | 204/272 X |
| 4,186,067 | 1/1980 | Blake et al. | 204/109 |
| 4,263,108 | 4/1981 | Berg et al. | 204/109 |
| 4,269,690 | 5/1981 | Graham III | 204/272 |
| 4,280,884 | 7/1981 | Babb et al. | 204/272 X |
| 4,302,318 | 11/1981 | Mock | 204/272 X |

*Primary Examiner*—Donald R. Valentine

*Attorney, Agent, or Firm*—Fleit, Jacobson, Cohn & Price

[57] ABSTRACT

A silver recovery system includes a novel power supply and a novel structure for a cell used in the recovery system. The power supply monitors the conductivity of the electrolyte of the silver recovery system and automatically sets power to the operating or standby modes depending on the magnitude of the conductivity. Thus, the system is capable of unattended operation. The cell consists of a canister which is a hollow cylinder having an open top end and a closed bottom end. The anode is an elongated rod and extends into the canister centrally thereof, and the cathode is a partial cylinder which surrounds the anode.

11 Claims, 7 Drawing Figures

F1
15

S1
11
10
T1
BR1
C27
B
To Fig. 5C
4
CR1
C1
C2
120 V - 60 Hz
3
Ø:12
U5
+5V
12
CR7
C11
C13
9
C12
C14
U6
-5V
CR8
Ø
KL1
CR11
F
LED 1-6
CR12
CR10
R16
G
CR9
R26
R25
A
R21
To Fig. 5C
R22
9
CR14
3 4 1 2 3 6
CR13
LD7
U2
10
8
CR19
S4a
C17
R27
R27
R19
-5V
+5V
R49
+12V
PA1
a4
CR20
R48
14
U2
13
R46
P11
12
R47
L

SILVER RECOVERY SYSTEM

The invention relates to a power supply for a silver recovery system. More specifically, the invention relates to such a power supply which monitors the conductivity of the electrolyte of the silver recovery system and automatically provides either operating or standby power depending on the magnitude of the conductivity, whereby to render the system capable of unattended operation.

The invention also relates to a structure for a cell for the silver recovery system.

The invention also relates to a silver recovery system incorporating the novel power supply, or the novel cell structure, or both.

Silver recovery systems are known in the art as illustrated in the following patents: U.S. Pat. No. 3,418,225, Wick et al, U.S. Pat. No. 3,551,318, Snook et al, U.S. Pat. No. 3,616,412, Gnage, U.S. Pat. No. 3,616,435, Favell et al, U.S. Pat. No. 3,705,716, Hendrickson, U.S. Pat. No. 3,751,355, Manroian, U.S. Pat. No. 3,875,032, Thompson, U.S. Pat. No. 3,980,538, Higgins, U.S. Pat. No. 4,127,465, Higgins, U.S. Pat. No. 4,186,067, Blake et al, and U.S. Pat. No. 4,263,108, Berg et al.

U.S. Pat. No. 3,418,225 teaches a silver reclaiming process wherein the amount of film entering into the electrolytic solution is counted. The apparatus continues the operation of the reclaiming process until the count is exhausted. U.S. Pat. No. 3,551,318 uses a separate detecting electrolytic cell 15 to control plating current. In U.S. Pat. No. 3,616,412, a coulometric device is used to determine the concentration of silver in a solution in a silver reclaiming apparatus and process. In U.S. Pat. No. 3,616,435, quiescent silver content is determined by measuring the film motion, and reclaiming current to said proportional to this content.

The apparatus as taught in U.S. Pat. No. 3,705,716 monitors effluent from a silver recovery unit to determine if the unit is still functioning efficiently. Thompson U.S. Pat. No. 3,875,032, teaches an apparatus which monitors threshold voltage required to induce flow of current at 0 silver content. Thompson uses a control cathode and electrode.

The teachings in U.S. Pat. Nos. 3,980,538 and 4,127,465 are similar in that the two patents are divisionals of the same application. The apparatus of both of these patents monitors the rate of input of film and increases plating current as the rate is increased. It also decreases plating current as the rate is decreased.

There is the implicit assumption that as the rate of input of film is increased, the silver content in solution increases, and vice versa.

The apparatus in U.S. Pat. No. 4,186,067 monitors the level of a reducing agent added to the silver solution to automatically add more agent when the level falls below a predetermined level and to automatically stop when the level exceeds a predetermined level. In U.S. Pat. No. 4,263,108, plating current is controlled as a function of cell voltage in the absence of plating current.

In the apparatus illustrated in U.S. Pat. No. 3,751,355, a sensing terminal 44 is connected to the negative terminal 46 of an electrolytic recovery cell to measure the conductivity of the electrolyte. The plating parameters of voltage and current are controlled as a function of the conductivity. As can be seen from FIG. 3, as the conductivity increases (resistance decreases) the current increases. Thus, the apparatus of this patent teaches a system wherein the parameters are varied in the light of conductivity measurements. However, it does not teach a system which can continue to operate unattended by putting the power in standby position when the silver content of the electrolyte becomes too low. In addition, the apparatus of the '355 patent requires that a probe be placed in the electrolyte. Such a probe provides its own problems, so that such a system could advantageously be improved on.

It is therefore an object of the invention to provide a power supply for a silver recovery system which overcomes the disadvantages of the prior art.

It is a further object of the invention to provide a structure for a cell for the silver recovery system.

It is a still further object of the invention to provide a novel silver recovery system incorporating the novel power supply or the novel cell structure, or both.

In accordance with the invention a power supply for a silver recovery system monitors the conductivity of the electrolyte and sets the input power to the system to either an operating or a standby level depending on the magnitude of the conductivity.

The cell comprises a canister which is a hollow cylinder having an open top end and a closed bottom end. An anode member extends longitudinally into the canister and a cathode member extends longitudinally into the canister and encircles the anode member.

The invention will be better understood by an examination of the following description, together with the accompanying drawings, in which:

FIG. 3 is a top view of a cell in accordance with the invention;

Figure 1:
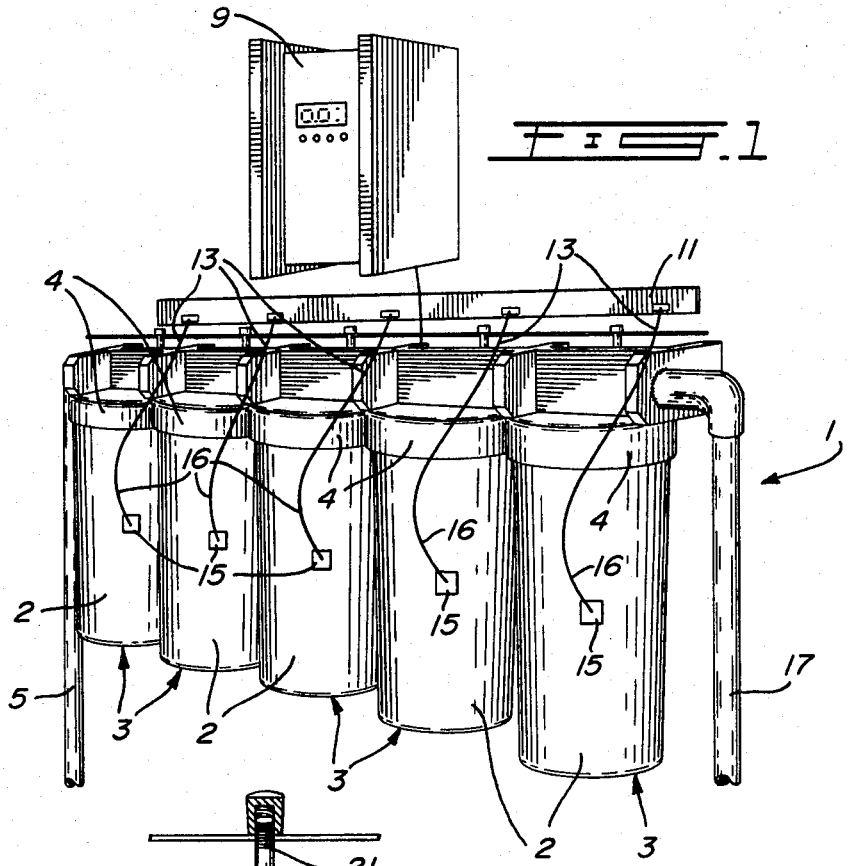
FIG. 1 is a perspective view of the system.

Referring to FIG. 1, a silver recovery system, illustrated generally at 1, comprises a plurality of cells 3 which cells are in fluid communication with each other. Connected to the cell at the inlet end (the lefthand side) is an inlet pipe 5, and connected to the cell at the outlet end (the righthand side) is an outlet pipe 7. The pipes 5 and 7 are connected to a source of silver. For example, if the source of silver is the fixing solution of a photographic process, then the pipes 5 and 7 would be connected to an outlet and inlet respectively of the container for the fixing solution. In that case, of course, the fixing solution will comprise the electrolyte of the cells. As can be seen, each cell includes a canister 2 and a cover 4.

Figures 5, 5B:
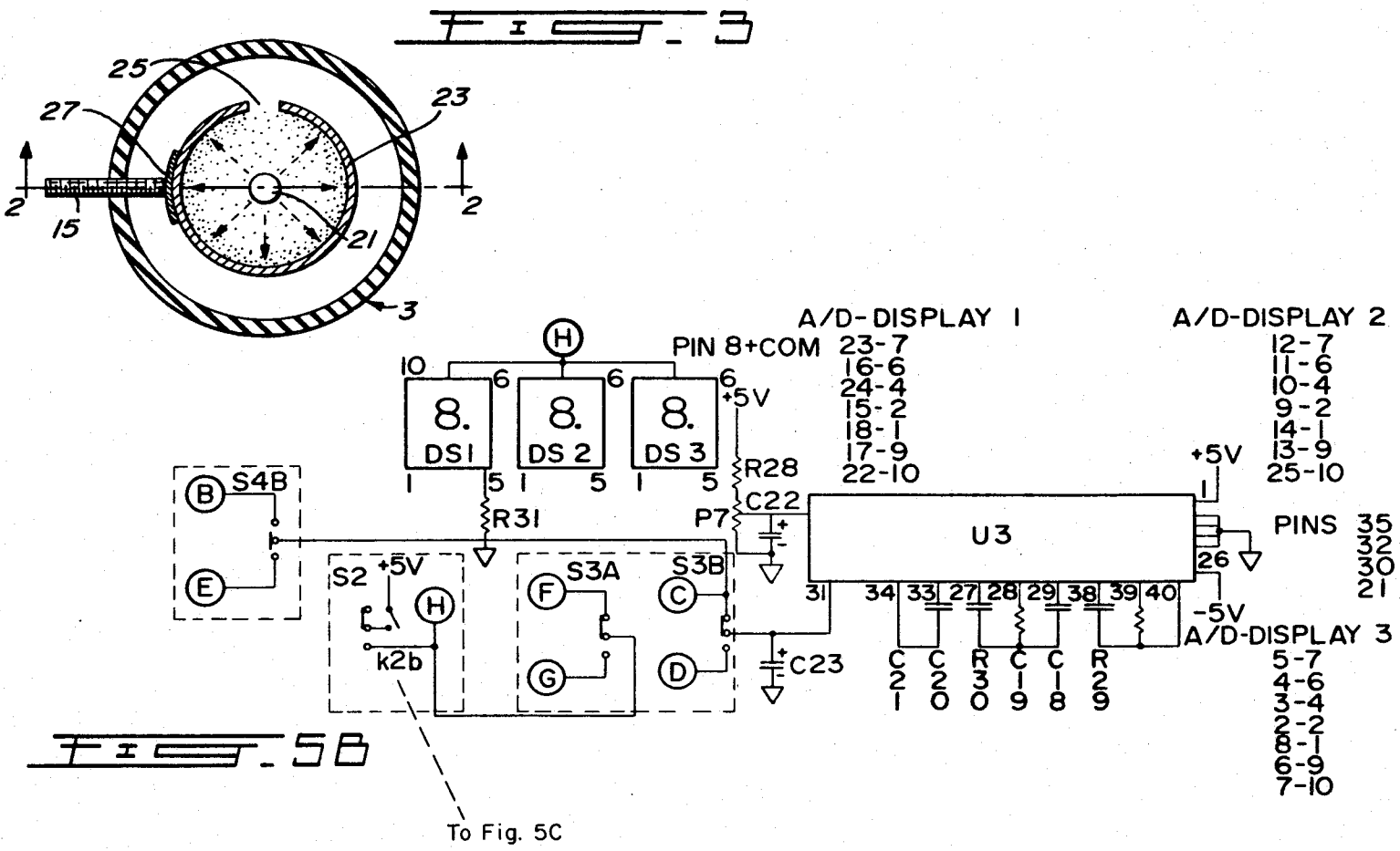
FIGS. 5A, 5B and 5C, when combined, show a schematic diagram of the power supply.
Figure 4:
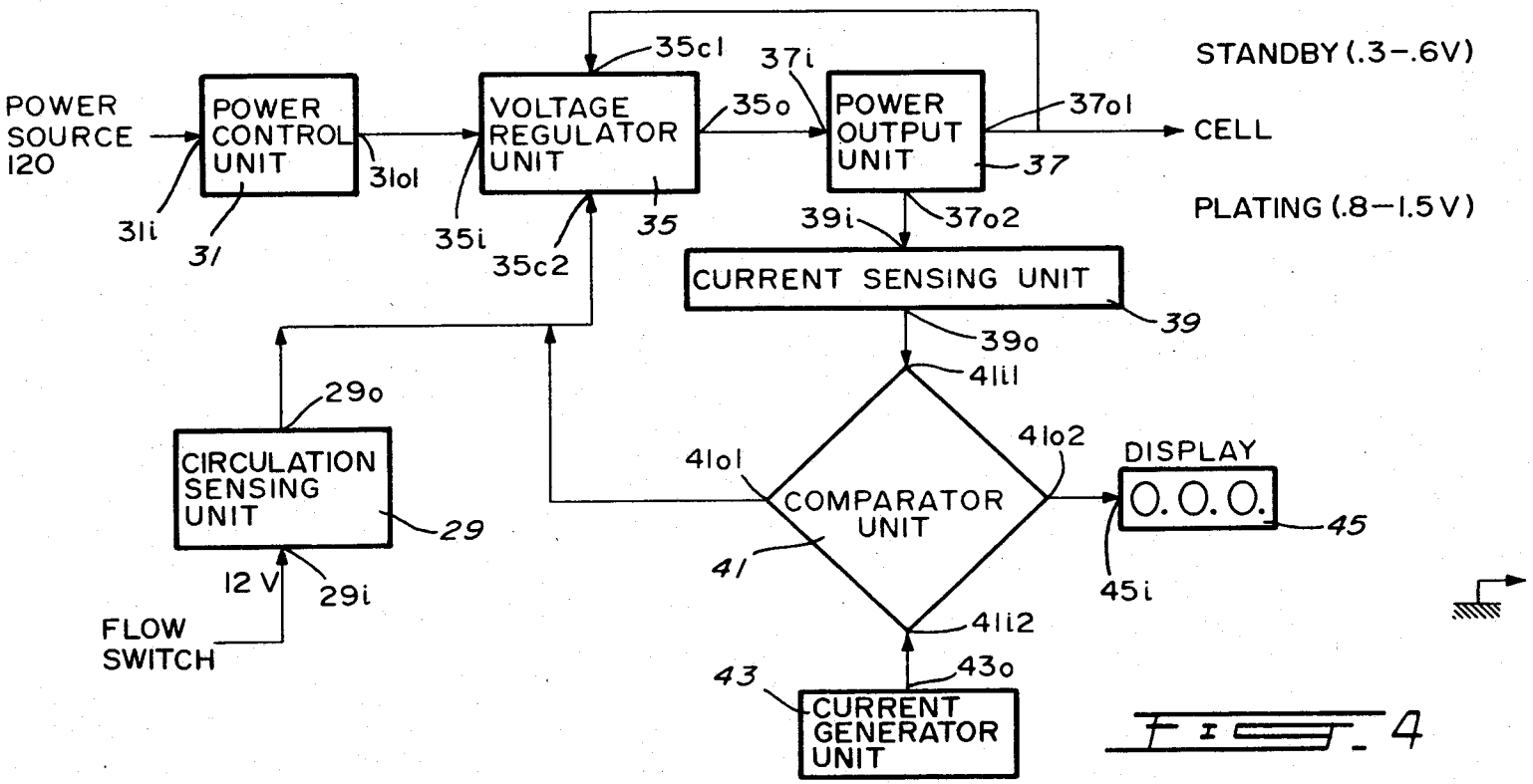
FIG. 4 is a block diagram of the power supply in accordance with the invention.

A circuit box 9 contains the electronics which are illustrated in FIGS. 4 and 5 herein. The electronics are connected to an anode common connector 11, and cables 13 lead from the common connector 11 to each respective cell anode.

Each cell includes a ground terminal 15 which, as will be described below, is connected to the cathode internally of the cells. Each respective terminal 15 includes a respective cable 16 which is connected to a ground point.

Figure 2:
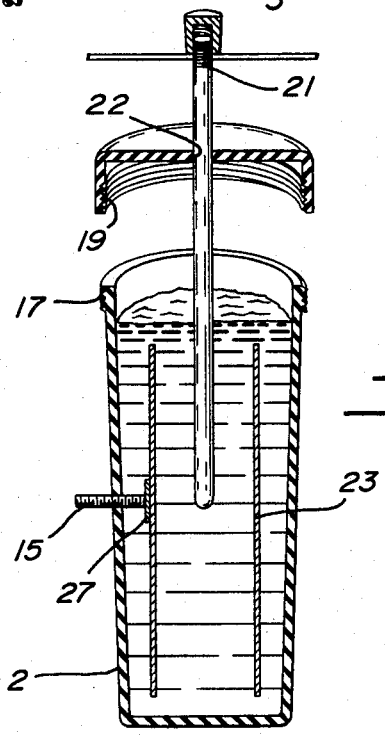
FIG. 2 is a cross-section through II—II of FIG. 3 and includes also a view of the cap shown in FIG. 1.

Turning now to FIG. 2, as can be seen, each canister comprises a cylinder with an open top end and a closed bottom end, and the cylinder includes a screw thread 17 at the outer surface at the top end thereof, and each cap 4 includes a mating screw thread 19 at the bottom end of the inner surface thereof. Anode 21, which is in the shape of an elongated rod and which comprises a graphite material, extends through an opening 22 in the top of the cap 4 into the interior of the canister. It is of course understood that, in FIG. 2, the cap is shown in exploded position relative to the canister.

As seen in FIGS. 2 and 3, the cathode comprises an elongated cylinder which also extends into the canister and which encircles the anode. As seen in FIG. 3, the side edges of the cathode are separated by a gap 25 which extends for the full length of the cathode.

Ground terminal 15 extends through a side wall in the canister and is connected to a bracket 27. The cathode comprises a metallic flat sheet which is rolled to be inserted into the canister so that when it is in the canister, it is in its sprung position and will force itself up against the inner surface of the walls of the canister. Accordingly, the bracket will be in good physical contact with the cathode and therefore also in good electrical contact therewith. In assembling the cell, the bracket is first inserted by lowering it on the interior of the canister and then pushing the ground terminal 15 outwardly through the opening in the canister. The cathode is then inserted in the canister.

Turning now to FIG. 4, the power supply comprises a circulation sensing unit 29 having an input **29*i* and output 29*o*. In addition, power control unit 31 has an output terminal 31*o*1. The output terminal of 31 is connected to input terminal 35*i* of voltage regulator unit 35. The voltage regulator has a first control terminal 35*c*1 and a second control terminal 35*c*2. It also has an output terminal 35*o*. The output terminal of 35 is connected to input terminal 37*i* of power output unit 37 which also has a first output terminal 37*o*1 and a second output terminal 37*o*2. The first output terminal of 37** is connected to the anode common connector and thereby, in parallel, to the anode of each cell in the system.

The second output of 37 is connected to the input terminal **39*i* of current sensing unit 39 which also has an output terminal 39*o*. The output terminal of 39 is connected to one input terminal 41*i*1 of comparator unit 41. The comparator unit has a first output terminal 41*o*1 which is connected to control terminal 31*c* of power control unit 31 as well as to the second control terminal 35*c*2 of voltage regulator unit 35. The comparator unit has a second output terminal 41*o*2 connected to a display unit 45. Finally, the comparator unit has a second input terminal 41i i2 which is connected to the output terminal 43*o* of current generator unit 43**. The current generator generates a predetermined amplitude of current as will be described below.

The input terminal **21*i*** of the processor sensing unit is connected to the source of silver to determine whether this source is in the processing state. For example, if the source of silver is a photography processing unit, then the processor sensing unit senses when circulation exists.

The power control unit 31 comprises of an AC/DC converter, and the voltage regulator regulates the voltage in view of the fact that very low amplitude voltages are used in this system. For example, when the system is plating, the voltage is in the range of 0.8 to 1.5 volts, when the system is in the standby condition, the voltage is between 0.3 and 0.6 volts, and when it is in the off mode, the voltage is 0.03 volts. In addition to the regulating function, the voltage regulator switches the output to the plating range, to the standby range and to the off mode on receipt of a signal from the comparator unit as will be described below. In addition, when it is in the plating mode, and when the current rises above a predetermined level, then the voltage regulator will automatically lower the voltage on receipt of a signal from the same comparator unit as will also be described below.

The power output unit 37 senses the voltage across each cell. In view of the fact that such low voltages are being used, the voltage measurement is taken directly across the anode and cathode of a cell. Thus, voltage losses of the wire conductors are taken into account. The output of the power unit is fed back to the voltage regulator to provide a feedback control system to maintain the voltage at the cells at its proper level.

The current sensing unit can comprise a high precision resistor in series between the power output unit 37 and the comparator 41.

In operation, the system operates as follows:

When the photography processing unit is first turned on, this will be sensed by unit 29 which will provide a signal to the voltage regulator unit to change the output from off mode to either plating or standby, depending on the current. The electrolyte is circulated through the cells and out through pipe 7 back to the processing system. Thus, in a photography system, the silver will be removed from the fixing solution whereupon the fixing solution can once again be used in the photography processing system.

If there is a small amount of silver in the electrolyte, then the conductivity of the silver will be very low (the resistance will be high), so that only a small amount of current will be drawn by the recovery system. This current is sensed by the sensing unit 39 and compared in the comparator unit 41 with the preset values of the current generator 43. When the sensed current is below a first preset value of the current generator, the comparator will provide a signal to the voltage regulator 35 to set it to its standby condition. At this time, the low voltage range (0.3 to 0.6 volts) permits further processing without harming chemicals in the electrolyte which would be harmed by higher voltages in the absence of sufficient silver in the electrolyte.

When the amount of silver in the electrolyte increases, the conductivity of the electrolyte increases so that more current will be drawn by the recovery system. When the sensed current exceeds the first preset value, the comparator provides a signal to the voltage regulator unit to set to its plating mode. Accordingly, the voltage will be increased to the 0.8 to 1.5 volts range. The silver in the electrolyte will now be plated onto the inner surface of the cathode for later recovery.

Should the conductivity of the electrolyte exceed the current limit of the unit, an influx of silver in the electrolyte, the comparator unit 41 will provide a signal to the voltage regula tor unit to reduce the voltage. However, it will not reduce a voltage within the plating level of voltages.

In presently available systems, when the processor unit is turned off, the silver recovery unit must also be turned off to avoid damaging it even though it could be doing useful work by recovering silver from the fixing solution even after the processing unit has been turned off. In accordance with the present power supply, the recovery system can continue operation until the conductivity level falls below a predetermined value. Thus, when the processor is turned off, the processor sensing unit will no longer be providing a turn on signal to the voltage regulator.

During operation, the display unit will display the magnitude of the sensed current. The current generator unit, in accordance with the invention, is adjustable as to the first and second preset levels. When the adjustments are being made, the preset levels will be displayed on the display unit. When the unit is in off mode, the display will turn off.

Figure 5A:
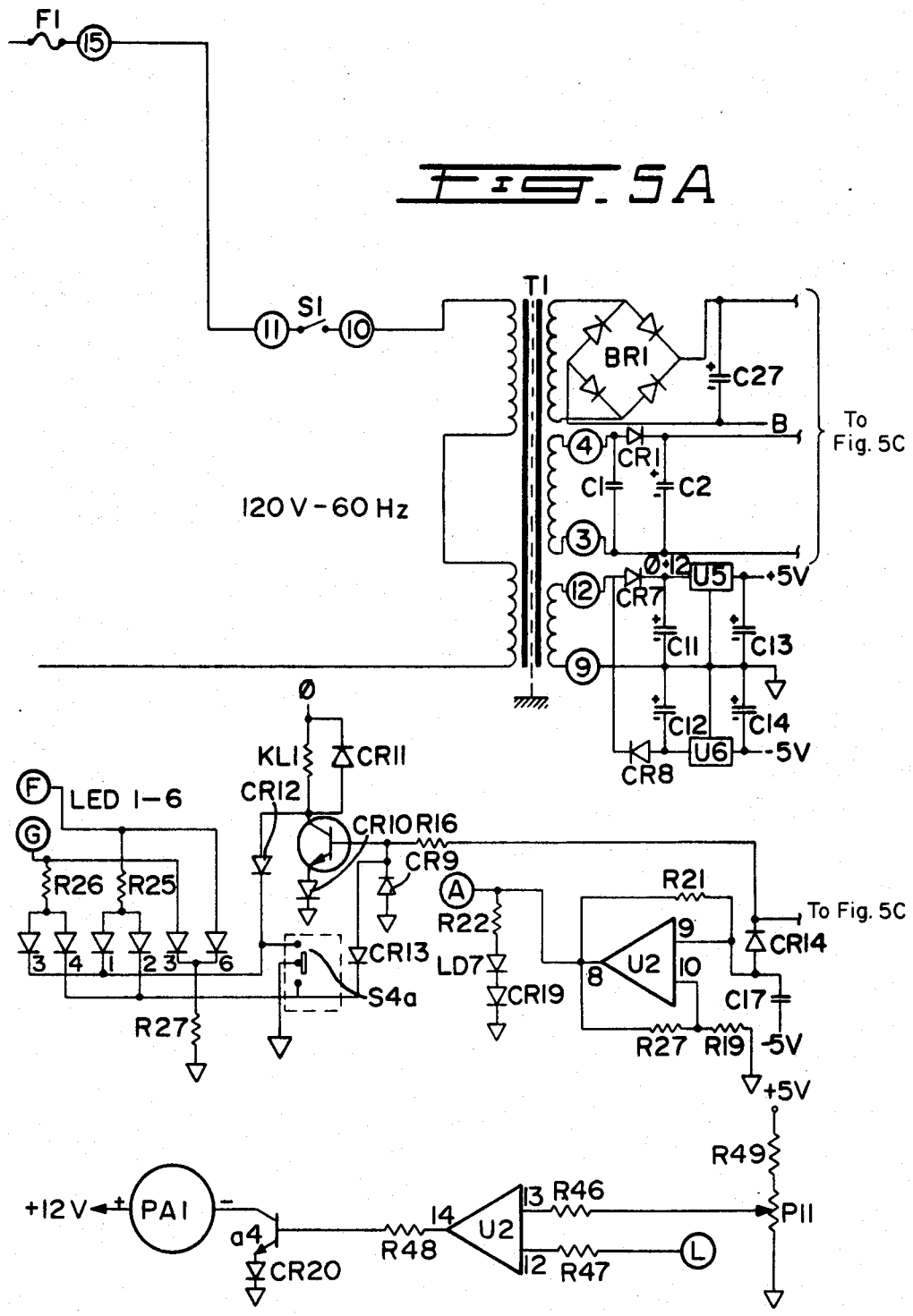
Figure 5C:
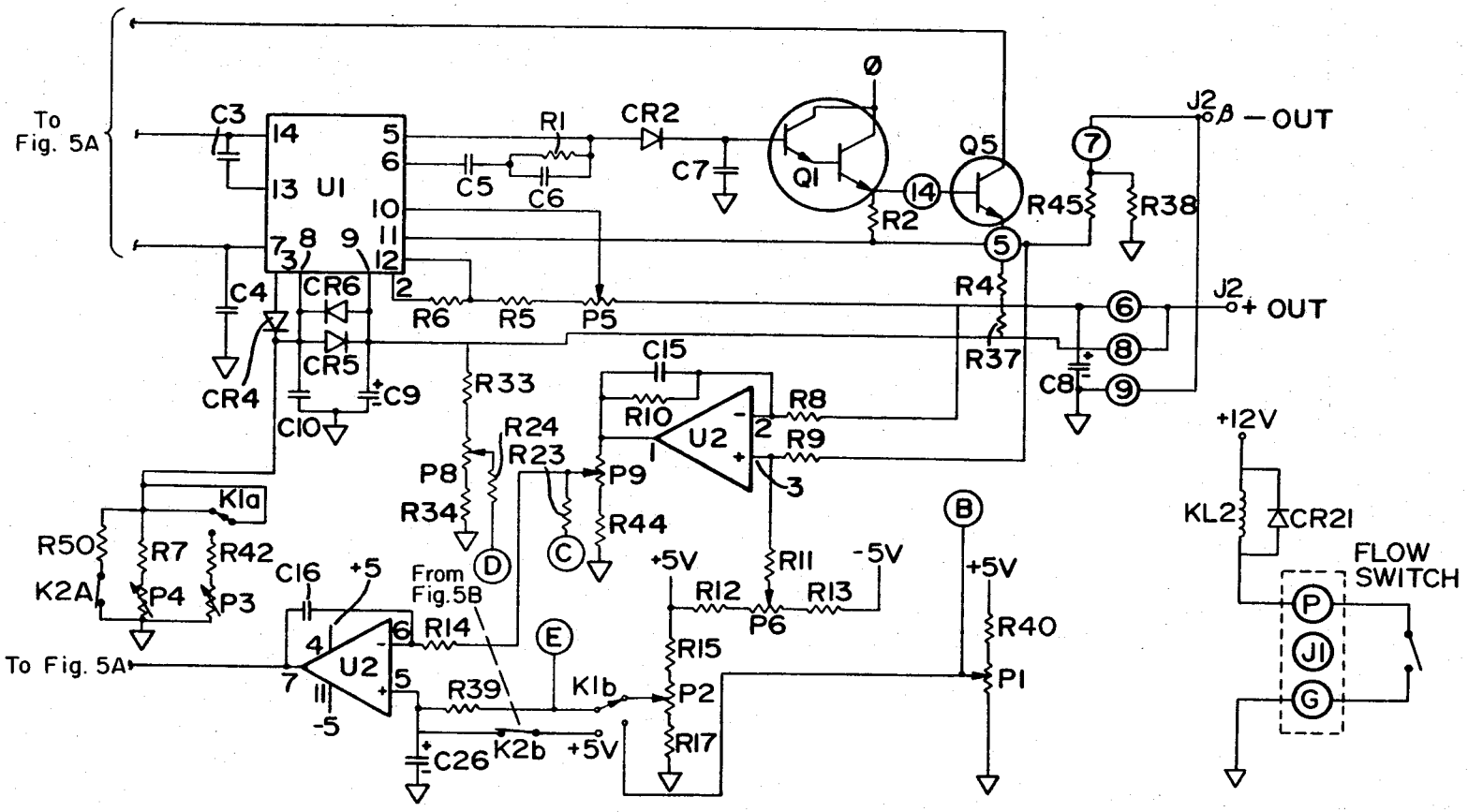

FIG. 5A, 5B, and C when combined illustrate a schematic diagram for implementing the block diagram of FIG. 4. The blocks enclosing the circuit elements bear reference numerals, and the reference numerals correspond to the reference numerals in FIG. 4. As will be understood, the circuit elements enclosed by a block are the circuit elements which are used to build the referenced block of FIG. 4. The operation of the schematic diagram, and each of the blocks within the schematic diagram, is self-evident and requires no further description.

Although a particular embodiment has been illustrated, this was for the purpose of describing, but not limiting, the invention. Various modifications, which will come readily to the mind of one skilled in the art, are within the scope of the invention as defined in the appended claims.

We claim,

1. A power supply for a silver recovery system, which system includes at least one cell, for holding an electrolyte containing the silver to be recovered, an anode, a cathode onto which the silver is plated, and a pump for pumping electrolyte to the cell;

said power supply comprising:

means for providing power to said cell, said means for providing power having an input terminal, a first output terminal, connected to the anode of said cell, a control terminal whereby to set said means for providing power to a standby level or a plating level, and a second output terminal;

means for sensing the current drawn from said means for providing power, said means for sensing having an input terminal, connected to said second output terminal of said means for providing power, and an output terminal;

current generator means for generating a current of a predetermined amplitude, said current generator means having an output terminal; and comparator means for comparing the amplitude of the sensed current with said predetermined amplitude having a first input terminal, a second input terminal and a first output terminal;

the output terminal of said means for sensing current being connected to the first input terminal of said comparator means;

the output terminal of said current generator means being connected to the second input terminal of said comparator means;

the output terminal of said comparator means being connected to the control terminal of said means for providing power;

whereby, when sensed current exceeds said predetermined amplitude, said means for providing power is set to said plating level, and when said sensed current is less than said predetermined amplitude, said means for providing power is set to said standby level.

2. A power supply as defined in claim 1 wherein said electrolyte is provided from a processor means, and further including a processor sensor means for sensing when said processor means is operative, said processor sensing means having an output terminal connected to a flow switch terminal of said means for providing a signal whereby to turn on said means for providing power when said processing means is in operation.

3. A power supply as defined in claim 2 wherein said current generator means is adjustable as to said predetermined amplitude.

4. A power supply as defined in claim 3 and further including an input terminal connected to a source of power, a first output terminal, a second output terminal and a control terminal;

said means for providing power still further comprising an AC/DC converter.

5. A power supply as defined in claim 3 wherein said first output terminal of said power control means is connected to a voltage regulator to provide a signal for the output.

6. A power supply as defined in claim 5 wherein said means for providing power further includes a voltage regulator means, said voltage regulator means having an input terminal connected to the second output terminal of said power control means, an output terminal, a first control terminal and a second control terminal, said second control terminal comprising said control terminal of said means for providing power.

7. A power supply as defined in claim 6 wherein said means for providing power still further comprises a power output unit having an input terminal connected to the output terminal of said voltage regulator means, a first output terminal, said first output terminal comprising said first output terminal of said means for providing power, and a second output terminal, said second output terminal comprising said second output terminal of said means for providing power.

8. A power supply as defined in claim 7 wherein said comparator includes a second output terminal, and further including a display means having an input terminal, said second output terminal of said comparator being connected to said input terminal of said display means.

9. A power supply as defined in claim 8 wherein the first output terminal of said comparator unit is connected to the control terminal of the power control unit and to the second control terminal of the voltage regulator unit, said current generator means being adapted to generate a current of a second predetermined amplitude, said second predetermined amplitude being greater than said predetermined amplitude;

whereby, when said sensed current exceeds said predetermined amplitude, said means for providing power is set to said plating level by said voltage regulator means;

and whereby when said sensed current is less than said predetermined amplitude and said processor means is operative, said means for providing power is set to said standby level by said voltage regulator unit;

and whereby, when said sensed current is less than said predetermined amplitude and said processor means is not operative, said means for providing power is turned off by said power control means.

10. A silver recovery system, comprising:

a plurality of cells for holding an electrolyte containing the silver to be recovered, the cells being in liquid communication with each other, and including an input end cell, and an output end cell;

each cell including an anode and a cathode onto which the silver is plated;

first pipe means, connected at one end thereof, to an output of a source of silver, and, at the other end thereof, to said input end cell;

second pipe means, connected, at one end thereof, to said output end cell, and at the other end thereof to said source of silver;

pump means for circulating said electrolyte from said source of silver through said cells and back to said source of silver;

a power supply for providing power to said cells whereby to plate said silver from said electrolyte onto said cathode;

wherein in that said power supply monitors the conductivity of the electrolyte in the cells and, when the conductivity falls below a predetermined level, sets the silver recovery system to a standby condition;

whereby, said silver recovery system is rendered capable of operating unattended;

characterized in that said power supply comprises:

means for providing power to said cell, said means for providing power having an input terminal, a first output terminal, connected to the anode of said cell, a control terminal whereby to set said means for providing power to a standby level or a plating level, and a second output terminal;

means for sensing the current drawn from said means for providing power, said means for sensing having an input terminal, connected to said second output terminal of said means for providing power, and an output terminal;

current generator means for generating a current of a predetermined amplitude, said current generator means having an output terminal; and comparator means for comparing the amplitude of the sensed current with said predetermined amplitude having a first input terminal, a second input terminal and a first output terminal;

the output terminal of said means for sensing current being connected to the first input terminal of said comparator means;

the output terminal of current generator means being connected to the second input terminal of said comparator means;

the output terminal of said comparator means being connected to the control terminal of said means for providing power;

whereby, when sensed current exceeds said predetermined amplitude, said means for providing power is set to said plating level, and when said sensed current is less than said predetermined amplitude, said means for providing power is set to said standby level.

11. A power supply as defined in claim 10 wherein said cell comprises:

a canister comprising a hollow cylinder having an open top end and a closed bottom end;

an anode member extending longitudinally into said canister; and a cathode member extending longitudinally into said canister and encircling said anode member.

* * * * *